United States Patent [19]

Kitzman

[11] 4,414,891

[45] Nov. 15, 1983

[54] CRUSHING APPARATUS

[76] Inventor: Donald G. Kitzman, 2004 W. 16th, Pueblo, Colo. 81003

[21] Appl. No.: 280,948

[22] Filed: Jul. 6, 1981

[51] Int. Cl.[3] ..... B30B 1/24

[52] U.S. Cl. ..... 100/245; 100/288; 100/295; 100/902

[58] Field of Search ..... 100/902, 53, 288, 240, 100/295, 256, 245, 179

[56] References Cited

U.S. PATENT DOCUMENTS

| | | | |
|---|---|---|---|
| 346,470 | 8/1886 | Elliott | 100/288 X |
| 2,737,995 | 3/1956 | Jennings | 100/902 X |
| 3,011,429 | 12/1961 | Kuslich et al. | 100/902 X |
| 3,024,720 | 3/1962 | Welsh | 100/245 X |
| 3,604,345 | 9/1971 | Boje | 100/179 X |
| 4,062,283 | 12/1977 | Kaminski | 100/902 X |
| 4,133,261 | 1/1979 | Belfils | 100/902 X |
| 4,188,875 | 2/1980 | Fabbri | 100/902 X |
| 4,197,796 | 4/1980 | Salatka | 100/902 X |
| 4,213,387 | 7/1980 | McCaney | 100/902 X |

*Primary Examiner*—Billy J. Wilhite

*Attorney, Agent, or Firm*—Timothy J. Martin; James R. Young

[57] ABSTRACT

A crushing apparatus adapted for crushing cans and the like has a piston assembly reciprocal within a cylindrical housing. The piston assembly includes a piston head and a drive rod which is provided with a plurality of gear teeth. The gear teeth of the drive rod are engaged by a circular gear mounted on a shaft positioned transversely in the housing with the shaft being rotatable by means of a crank arm to reciprocate the piston assembly in the housing. An end wall secured to the housing defines a fixed crushing surface while the piston head provides a movable crushing surface. An enlarged entry opening is provided in the housing to permit insertion of a can to be crushed between the fixed and movable crushing surfaces with the piston head being movable completely past this opening. An exit opening is also provided in the housing, preferably at an angularly spaced-apart orientation to the entry opening with the exit opening permitting the removal of the can after it has been crushed. Lid assemblies enclose both openings so that the can is completely encased in the apparatus during the crushing operation, and a limit stop is provided to prevent the piston head from actually contacting the fixed crushing surface.

15 Claims, 8 Drawing Figures

CRUSHING APPARATUS

BACKGROUND OF THE INVENTION

The present invention relates to a crushing apparatus and, more particularly, to a device adapted for crushing cans and the like. The present invention is particularly useful for collapsing aluminum cans such as the type commonly used by the beverage industry.

In the past several years, public consciousness has become more aware of the advantages of recycling various products which were formerly thought of as waste materials and which were discarded. One such material that has received attention has been aluminum which is the main component of cans used by the beverage industry. Both the rise in the cost of aluminum and the ease of recycling aluminum continues to generate an increasing interest in recycling aluminum cans. However, the relatively large size of aluminum cans with respect to the weight of the cans prevents the convenient storage or transportation of a sufficiently large number of cans to justify recycling. In order to amass a sufficient quantity of cans to be practical for recycling, then, a large volume of storage space is required. It is desirable to reduce the required storage space while permitting collection of a sufficient number of the aluminum cans to be recycled.

Several prior art patents have sought to develop crushing apparatus designed to collapse cans, and aluminum cans in particular, but their use has not become wide spread. For example, U.S. Pat. No. 4,188,875 issued Feb. 19, 1980 to Fabbri et al. discloses a can crusher wherein a crushing mechanism is mounted on a flat base in the form of an open framework in a generally T-shaped configuration. A lever drives a piston member, which is slideably mounted in this framework so that a can is crushed by the piston with mechanical advantage being gained by the lever assembly. As the piston is withdrawn, the crushed can may fall out of the framework past the end of the base of the mechanism.

U.S. Pat. No. 4,213,387, issued July 22, 1980 to McCaney et al. also discloses a crushing mechanism designed to collapse cans. In this patent, a piston member is mounted in an open framework with the side walls of the framework having slots to guide the piston member as it is driven under the influence of the lever handle. In this mechanism both the piston and the crushing surface in the form of an end wall of the mechanism are slightly canted to overcome the can's initial resistance to compression.

In U.S. Pat. No. 4,197,796, issued Apr. 15, 1980 to Salatka and U.S. Pat. No. 4,133,261, issued Jan. 9, 1979 to Belfils, vertically mounted can crushers are provided wherein a vertical crushing piston is operated by a lever to collapse an aluminum can or the like. In the Salatka patent the piston has a cut out portion to receive the rim of the can to help retain the can as it is being crushed while the Belfils' patent provides a nub on the piston to crimp the can initially as it is being collapsed and an air port is provided to allow air to exit the can as it is being crushed.

While these prior art devices accomplish the main objective of crushing a can, the use of an open framework and lever assembly can present certain dangers to the user. One such danger is the chance that the user or others may accidentally insert his fingers into the apparatus while it is being operated, and, as a result, be in danger of injury either from the crushing piston or from the lever's linkage. Another problem presented by an open framework is the chance that a can might be propelled out of the mechanism while it is being crushed so that it may strike an object or person in the vicinity with great force which could cause injury. Accordingly, it is desirable to eliminate these problems while at the same time maintaining ease of operability and integrity of the crushing apparatus.

SUMMARY OF THE INVENTION

It is an object of the present invention to provide a novel and useful crushing apparatus operable to crush cans and the like which is both safe and easy to operate.

It is another object of the present invention to provide a crushing apparatus which completely encloses a can to be crushed during the crushing operation.

A still further object of the present invention is to provide a manually operable crushing device wherein mechanical advantage is gained by a gearing system.

A still further object of the present invention is to provide an inexpensive crushing apparatus which limits the motion of a crushing piston and which automatically releases a crushed can at the end of the crushing cycle.

To accomplish the above objects, the present invention comprises a crushing apparatus mounted on an elongated, enclosed housing which is supported on any convenient surface. One enclosed end of this housing provides a fixed, rigid crushing surface against which a can may be compressed by means of a piston which moves in the housing. A piston head is sized to correspond to the cross-sectional area of the housing and the piston head is mounted on the end of the piston rod or drive shaft which is supported in any convenient manner in the housing. The piston assembly is reciprocated in the housing with the piston head defining a movable crushing surface operative on a can placed in the apparatus. In the preferred embodiment of this invention, the piston rod has a plurality of gear teeth on one edge and a shaft is mounted transversely in the housing and is rotatably journaled therein. This shaft supports a gear which engages the teeth on the piston rod, and the shaft is rotated by means of a crank arm.

Preferably, the housing is cylindrical and a can is inserted into the apparatus through a lateral opening approximating the size of a can to be crushed. As the piston head reciprocates in the housing, the crushing surface of the piston head moves completely past this opening. A limit stop is provided to prevent the piston head from contacting the fixed crushing surface of the housing. The distance between the piston head and the endwall at the limit stop thus corresponds to the height of a can after it has been crushed. Once the crushing operation has been carried out the crushed can may exit the apparatus through a downwardly oriented opening which has a circumferential length corresponding to the diameter of a crushed can and a longitudinal width slightly larger than the distance of closest approach of the movable crushing surface to the fixed crushing surface. This opening is immediately adjacent the fixed crushing surface so that, as the piston head is withdrawn, the crushed can may fall through the opening to be collected by the user. To further enhance the safety of the apparatus, a lid housing is provided for both the entry opening and the exit opening with these lids being normally in a closed position. Central holes are provided in both the end wall and the piston head to allow the escape of any contents of the can, and a crimping ridge may be provided on the crushing surface of the piston head to provide an initial crimping action on the can to facilitate the collapsing operation. Other objects, advantages and features of the present invention will become more readily appreciated and understood when taken together with the following detailed description in conjunction with the accompanying drawings, in which:

DETAILED DESCRIPTION OF THE PREFERRED EMBODIMENT

The present invention relates to a crushing apparatus particularly adaptable for crushing cans and the like. Broadly, to accomplish this objective, a crushing member in the form of a piston is reciprocally mounted in an enclosed housing which has an entry opening for an uncrushed can and an exit opening for the can after it has been collapsed. In the preferred embodiment of the present invention this mechanism is manually operable, but it should be appreciated that it's within the scope of this invention to provide various other drive means for the reciprocating piston.

Figure 1:
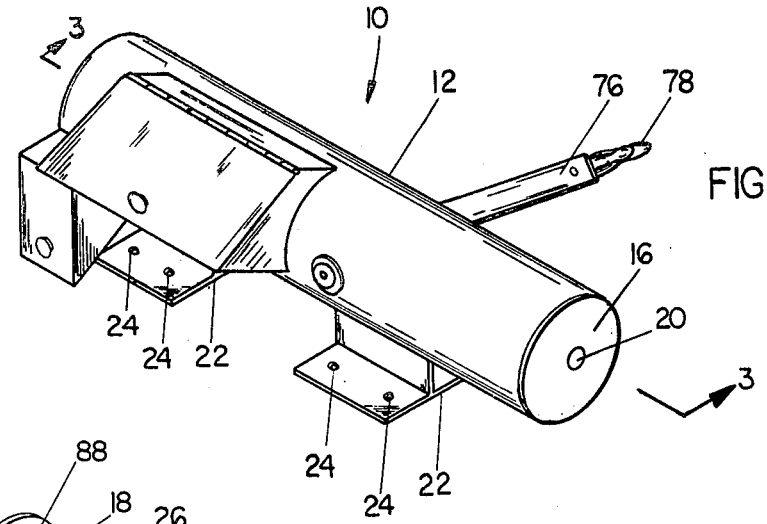
FIG. 1 is a perspective view of a can crushing apparatus according to the preferred embodiment of the present invention.
Figure 2:
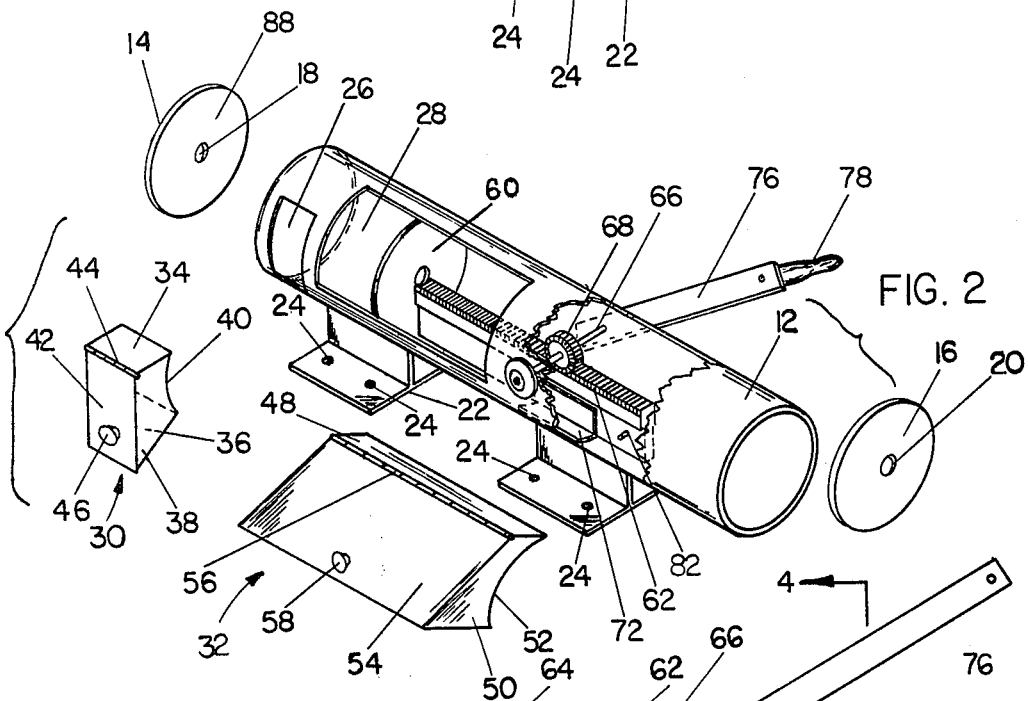
FIG. 2 is an exploded view in perspective of the can crushing apparatus shown in FIG. 1.
Figure 3:
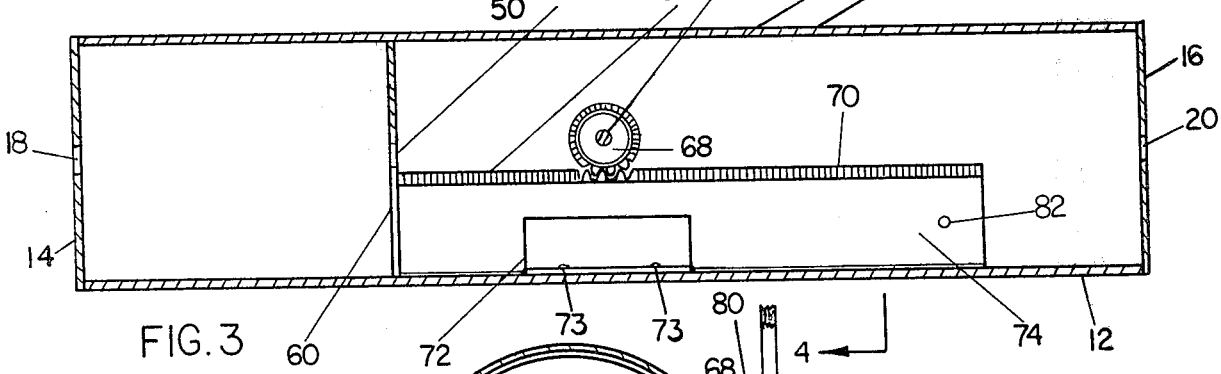
FIG. 3 is a cross-sectional view taken about lines 3—3 of FIG. 1.

With more specificity, the preferred embodiment of the present invention is best shown in FIGS. 1 and 2 wherein the can crushing apparatus 10 includes an elongated cylindrical housing 12 made of a strong, rigid material, such as 20 gauge steel, which is enclosed on either end by circular end plates 14 and 16 having small central openings 18 and 20, respectively. Housing 12 is approximately 40 centimeters long and has an inside diameter of approximately 9 centimeters. End plates 14 and 16 are preferably made from 8 gauge steel. A pair of mounting brackets 22 are provided to mount cylindrical housing 12 on a support surface such that the longitudinal axis of cylindrical housing 12 is parallel to that surface. Brackets 22 have a plurality of holes 24 provided for receiving a screw, bolt, or other conventional member to secure brackets 22 to the support surface.

Two openings 26 and 28 are cut into the circular side wall of housing 12 at one end thereof. As may be seen in FIG. 2, opening 26 is longer in a circumferential or angular direction and narrower in its longitudinal direction, and opening 26 is positioned in closely spaced relation to end plate 14 when end plate 14 is mounted to housing 12. Opening 26 is sized so that its circumferential or angular length corresponds to the diameter of a can to be crushed while its longitudinal width corresponds to the height of the can after it has been collapsed by can crushing apparatus 10. Preferably, opening 28 is angularly offset from opening 26 and, in the preferred embodiment, openings 26 and 28 are angularly offset approximately 90 degrees from one another. Opening 26 is angularly offset from brackets 22 at an approximately 45 degree angle with opening 28 being angularly offset approximately 135 degrees from brackets 22. Lid housing assemblies 30 and 32 respectively cover openings 26 and 28. Lid housing assembly 30 includes a top wall 34, a bottom wall 36 and a pair of sidewalls 38 which are spaced apart a distance corresponding to the width of opening 26 and are parallel to one another. The sidewalls 38 have a curved edge 40 which has a radius of curvature equal to the radius of curvature housing 12 so that lid housing assembly 30 may be mounted securely to housing 12 as is shown in FIG. 1. An elongated lid 42 is pivotly attached to an edge of top wall 34 by means of hinge 44 and is manually movable by means of a gripping knob 46 provided at a lower end opposite hinge 44.

Lid housing assembly 32 is constructed similarly to lid housing 34 and has a top wall 48, a bottom wall (not shown) and a pair of side walls such as side wall 50 shown in FIG. 2. Each side wall 50 has a curved edge 52 which has a radius of curvature corresponding to the radius of housing 12 so that head housing assembly 32 may be mounted flush against housing 12 to enclose opening 28. Accordingly, side walls 50 are parallel to one another and spaced apart a distance corresponding to the longitudinal length of opening 28. A lid 54 is pivotly secured to an edge of top wall 48 by means of hinge 56 and a knob 58 is provided adjacent an edge of lid 54 opposite hinge 56 so that a user may manually grip knob 58 to pivot lid 54 thereby allowing access to opening 28. Lid 54 may be resiliently biased in its closed position.

Cylindrical housing 12 mounts a crushing mechanism which, according to preferred embodiment of the present invention, is best shown in FIGS. 2–5. The crushing mechanism includes a piston assembly which is mounted for reciprocal motion axially in cylindrical housing 12. Specifically, a piston head 60 is attached to a drive shaft or rod 62 with piston head 60 being oriented in a plane perpendicular to the axis of housing 12. Piston head 60 has a centrally located hole 64 adjacent the location of the attachment of drive rod 62, and is constructed of strong, rigid metal, such as 20 gauge steel.

As noted, piston head 60 is reciprocal in housing 12, and, to accomplish this reciprocal motion, a drive means is provided to operate on drive rod 62 to move it axially back and forth within housing 12. In the preferred embodiment of the present invention, the drive mechanism includes a shaft 66 which is rotatably journaled transversely in housing 12 and is supported at opposite ends by the cylindrical sidewall of housing 12. Axle or shaft 66 is approximately one centimeter in diameter and rigidly mounts a gear 68 for common rotation therewith, and drive rod 62 is provided with a plurality of teeth 70 along a portion of its length so that teeth 70 engage corresponding teeth on gear 68. Accordingly, when shaft 66 is rotated, gear 68 rotates correspondingly which in turn propells drive rod 62 reciprocally in housing 12, depending on which direction shaft 66 is rotated. Gear 68 is approximately 2.85 centimeters in diameter, and it has been found that the toothed portion of drive rod 62 should be at least 20 centimeters long. Drive rod 62 is maintained in engagement with gear 68 by means of a pair of support guide brackets 72 which are secured to housing 12 in any convenient manner, such as by screws 73. An elongated wing 74 is connected to drive rod 62 on a surface opposite teeth 70 and wing 74 is received between guide brackets 72 which are mounted to the interior side wall of cylindrical housing 12 in spaced apart parallel relation to one another. Thus, drive rod 62 is both supported by guide brackets 72 and is guided for longitudinal or axial movement in housing 12 by means of the interaction of guide brackets 72 in positioning wing 74.

Figure 4:
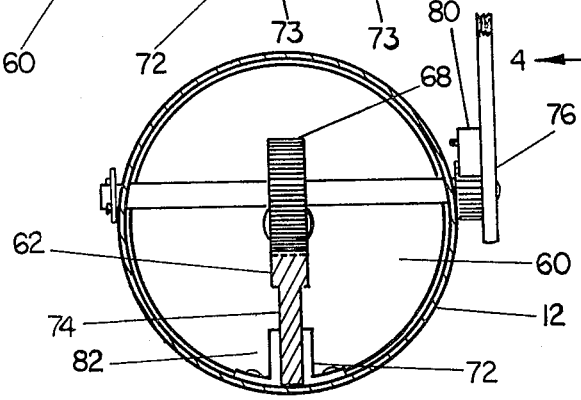
FIG. 4 is a cross-sectional view taken about lines 4—4 of FIG. 3.
Figure 5:
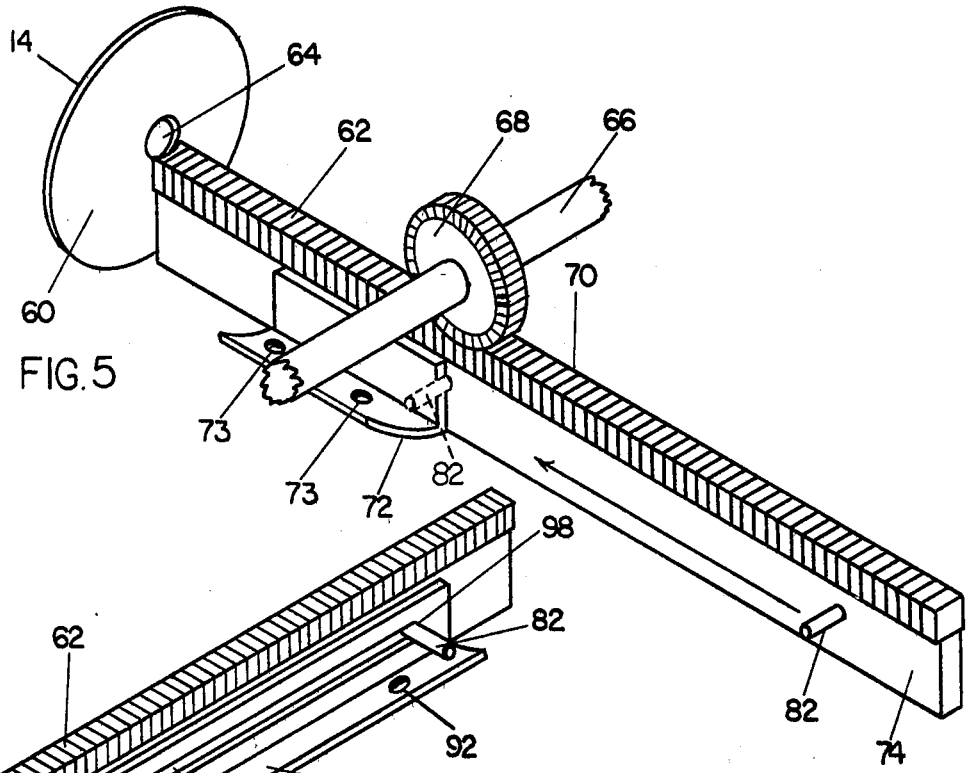
FIG. 5 is a perspective view of the crushing mechanism according to the preferred embodiment of the present invention.

While it should be appreciated that any convenient means for rotating shaft 66 is within the scope of the present invention, in the preferred embodiment of this invention, such rotation is supplied manually by means of a crank arm 76 which is mounted to shaft 66 and which has a gripping handle 78 at an end of crank arm 76 opposite shaft 66. Handle 78 is rotatably secured to crank arm 76 in any convenient manner to provide greater ease in operation. Further, as is shown in FIG. 4, crank arm 76 is secured to shaft 66 by means of a conventional ratchet type assembly 80 so that piston head 60 may be advanced towards end wall 14 without the necessity of turning crank arm 76 through a complete 360 degree rotation.

Since it is desirable that piston head 60 be only allowed to closely approach but not touch end plate 14, limit stop means is provided in the preferred embodiment of the present invention in the form of a post 82 mounted to wing 74. Post 82 extends transversely through and is secured in a bore in wing 74 so that opposite ends of post 82 project laterally on either side of wing 74. As drive rod 62 is advanced so that piston head 60 approaches end plate 14, post 82 will approach the edge guide brackets 72. Post 82 is positioned so that when piston head 60 is approximately one centimeter from end of plate 14, post 82 will contact guide brackets 72 to prevent further advancement of drive rod 62 and accordingly piston head 60, as shown in phantom in FIG. 5. In the reverse direction, piston head 60 is prevented from contacting gear 68 since piston head 60 will first abut guide brackets 72 which therefore limits motion in the reverse direction.

Figure 8:
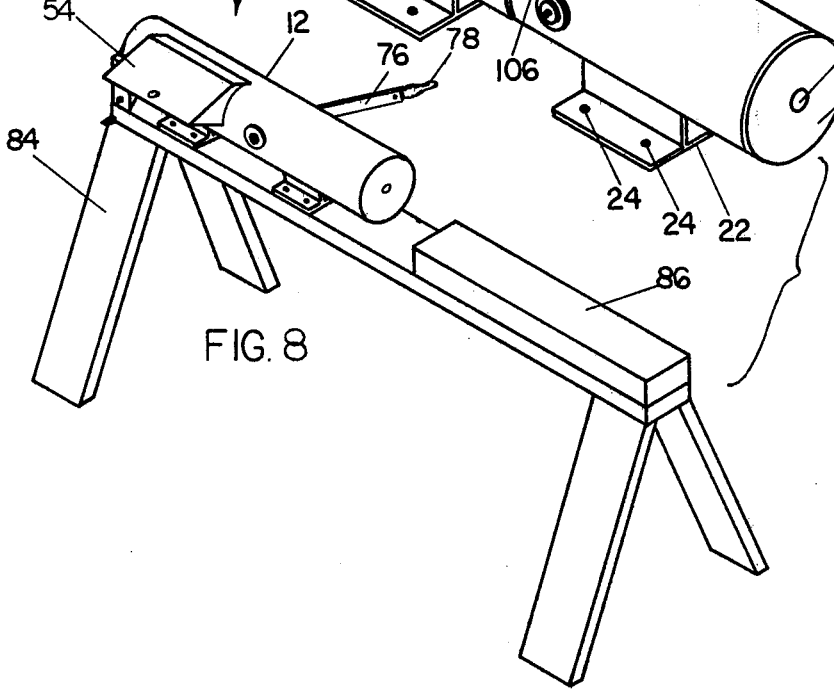
FIG. 8 is a perspective view of the preferred embodiment of the present invention mounted on a support structure.

In operation, then, a can crushing apparatus 10 is mounted on a suitable support surface such as shown in FIG. 8 wherein can crushing apparatus 10 is positioned on a saw horse 84 which has a cushion 86 so that a user may sit on cushion 86 while straddling saw horse 84. Crank arm 76 is then rotated in a reverse direction so that piston head 60 is moved a maximum distance away from end plate 14. Lid 54 is raised, and a can to be crushed is inserted through opening 28 so that it is positioned between end plate 14 and piston head 60. Accordingly, the interior surface 88 of end plate 14 provides a fixed crushing surface while the surface of piston head 60 facing end plate 14 provides a movable crushing surface. Crank arm 76 is then rotated to advance drive rod 62 which moves piston head 60 towards end plate 14. Due to the mechanical advantage gained by crank arm 76 and gear 68, a can placed in crushing apparatus 10 is thus compressed in a direction towards end plate 14. Movement of crank arm 76 is then reversed so that piston head 60 moves away from end plate 14, and the user may then remove the collapsed can from the apparatus by raising lid 42 and allowing the collapsed can to fall through opening 26 and lid housing assembly 30. It should be appreciated, then, that in its operation the piston head is movable completely past opening 28 between a first location adjacent and fixed crushing surface and a second location adjacent guide bracket 72. While the limit stop means in the form of post 82 allows such motion, it prevents piston head 60 from contacting end plate 14, so that, should the fingers of the user or bystanders or some other object get inserted into the apparatus, a degree of protection is provided against crushing such object against end plate 14. Further, by completely enclosing the can during the crushing operation, the can is prohibited from inadvertantly springing out of the apparatus to cause damage.

Figure 6:
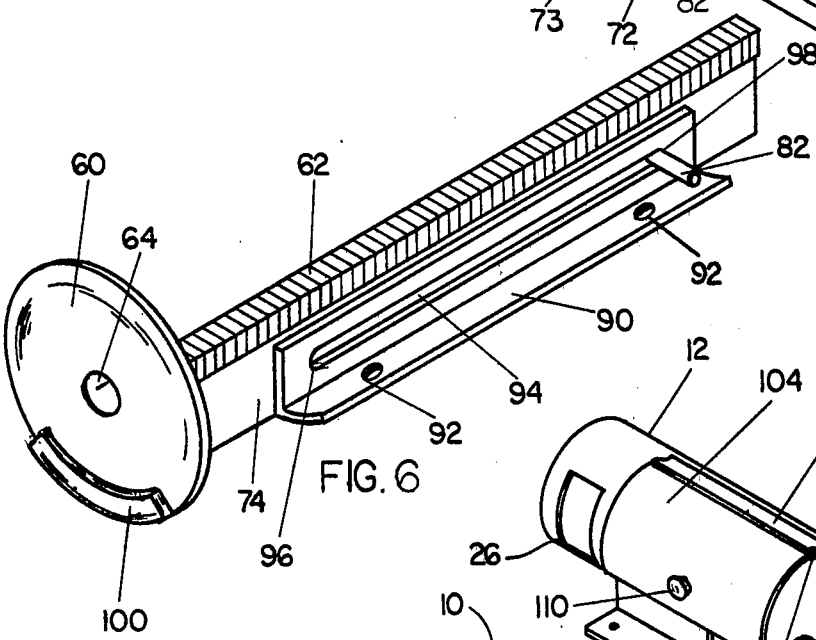
FIG. 6 is a perspective view of an alternate embodiment of the crushing piston assembly.

FIG. 6 shows an alternate embodiment of the guide bracket assembly and limit stop means according to the present invention. Here, a pair of elongated guide brackets 90 are mounted on either side of wing 74 which is attached to drive rod 62 with guide brackets 90 being secured to the inner side wall of cylindrical housing 12 by means of a plurality of screws 92. Each guide bracket 90 is provided with an elongated slot 94 extending parallel to the direction of movement of drive rod 62 and post 82 is positioned in each slot 94. Thus, as drive rod 62 is reciprocated in cylindrical housing 12 to drive piston head 60, post 82 moves in slot 94. A limit stop means is then provided when post 82 contacts either end 96 or end 98 of slot 94 while at the same time drive rod 62 is positively supported throughout its movement.

An alternate embodiment of piston head 60 is shown in FIG. 6 wherein piston head 60 is provided with a raised portion 100 in the form of an arched ridge 100 adjacent the peripheral edge of piston head 60. Arched ridge 100 extends for approximately one quarter the distance around piston head 60 and is preferably oriented so that it is adjacent a lower portion of the interior side wall of cylindrical housing 12 when can crushing apparatus 10 is mounted on a support surface. In operation, when piston head 60 is advanced toward a can to be crushed, arched ridge 100 first comes in contact with a rim of the can so that it concentrates the force applied by piston head 60 to initially crimp the can along that rim so that the crushing operation proceeds more easily.

Figure 7:
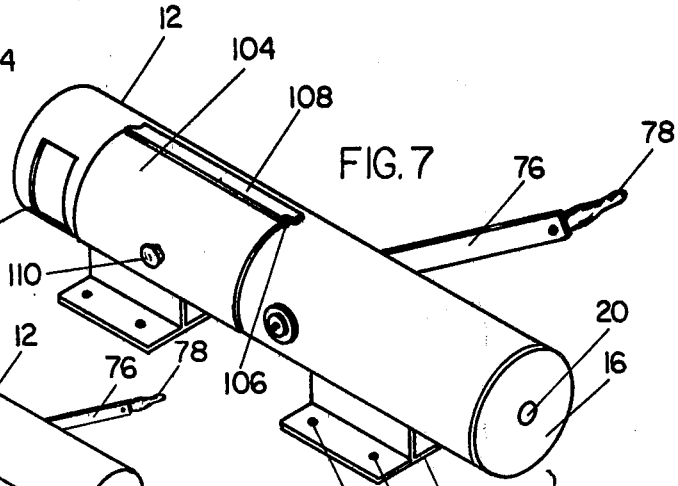
FIG. 7 is a perspective view of an alternate embodiment of the housing structure according to the present invention.

FIG. 7 discloses an alternate structure for enclosing opening 28 wherein an arcuate lid 104 is mounted by means of a hinge 106 directly to the exterior side wall of cylindrical housing 22. A limit bracket 108 is secured to cylindrical housing 12 adjacent hinge 108 so that, when lid 104 is raised by means of knob 110, it will abut bracket 108. Bracket 108 is sized so that the center of mass of lid 104 cannot be oriented vertically of hinge 106. Accordingly, when can crushing apparatus 10 is mounted on a horizontal surface, lid 104 will automatically return to a closed position when it is released by the user.

While the present invention has been described with some degree of particularity, it should be appreciated that the present invention is defined by the following claims construed in light of the prior art so that modifications or changes may be made to the preferred embodiment of the present invention without departing from the inventive concepts contained herein.

I claim:

1. A crushing apparatus comprising:

an elongated hollow housing having a surrounding sidewall and a first endwall defining a fixed crushing surface, said sidewall having a first opening adjacent said first endwall and a second opening longitudinally spaced from said first opening;

a piston assembly mounted for reciprocal motion in said housing and including a drive shaft oriented parallel to the axis of said housing and a crushing head attached to an end of said drive shaft facing said fixed crushing surface and defining a movable crushing surface, said drive shaft including a flat wing of reduced thickness projecting outwardly therefrom and extending substantially the full length of said drive shaft;

a pair of guide brackets each secured along one edge to said sidewall and having flat surfaces oriented in parallel relation to one another on either side of said flat wing, said guide brackets each having an edge opposite its respective said one edge that terminates in closely spaced parallel relation to said drive shaft, said guide brackets operative to support and guide said drive shaft during its reciprocal movement; and drive means associated with said drive shaft for reciprocally moving said crushing head between a first location adjacent said fixed crushing surface and second location on a side of said second opening opposite said first opening whereby said movable crushing surface is movable completely past the longitudinal length of said second opening.

2. A crushing apparatus according to claim 1 wherein said first and second openings are axially offset from one another.

3. A crushing apparatus according to claim 2 wherein said first opening has a longitudinal width less than its angular height and said second opening has a longitudinal width greater than its angular height.

4. A crushing apparatus according to claim 1 wherein said drive means includes a transverse axle rotatably journaled in said housing, a gear element secured to said axle and a crank arm connected to said axle adapted for rotating said axle, said drive shaft having teeth on a surface thereof engaging said gear.

5. A crushing apparatus according to claim 4 including a ratchet element interconnecting said axle and said crank arm.

6. A crushing apparatus according to claim 1 including mechanical limit stop means associated with said drive shaft for prohibiting said crushing head from contacting said fixed crushing surface.

7. A crushing apparatus according to claim 1 wherein said crushing head includes an upstanding ridge on said movable crushing surface adjacent its edge and extending for a portion of the perimeter of said movable crushing surface.

8. A crushing apparatus according to claim 1 including a second endwall on an end of said housing opposite said first endwall, said first and second endwalls and said crushing head each having an axial bore therethrough.

9. A crushing apparatus according to claim 1 including a first lid assembly covering said first opening and having a first upright wall surrounding said first opening and a first lid element hinged to said first upright wall, and a second lid assembly covering said second opening and having a second upright wall surrounding said second opening and a second lid element hinged to said second upright wall.

10. An apparatus for crushing cans and the like comprising:

an elongated cylindrical housing having an endwall defining a fixed crushing surface and a surrounding sidewall, said sidewall having a first opening adjacent said end wall and a second opening in an axially spaced-apart relation from said first opening;

a piston head mounted for axial movement in said housing from a first location on a side of said second opening opposite said first opening to second location adjacent said endwall, said piston head defining a movable crushing surface;

a drive rod attached to said piston head and axially movable to drive said piston head between said first and second locations, said drive rod including gear teeth on one edge thereof;

a support bracket slideably mounting said drive rod to said housing and having a longitudinal slot formed therein;

a post member secured to said drive rod and positioned to engage said slot whereby said post and said slot define a limit stop for the axial movement of said piston head; and drive means associated with said drive rod for reciprocally moving said drive rod, said drive means including a gear element having teeth engaging the teeth on said drive rod, said gear element being supported on a shaft rotatably mounted on said housing.

11. A crushing apparatus according to claim 10 including a pair of mounting post elements attached to the exterior surface of said sidewall and projecting radially outwardly therefrom and adapted to support said housing in spaced relation to a mounting surface.

12. A crushing apparatus according to claim 11 wherein said first and second openings are generally rectangular in shape, said first opening having a larger dimension in an angular direction and said second opening having a larger dimension in a longitudinal direction, said first and second openings being angularly offset from one another with said second opening facing a radial direction at approximately a right angle to said mounting post elements with said first opening facing a radial direction of an acute angle with respect to said mounting post elements.

13. A crushing apparatus according to claim 11 including a lid element, a hinge connecting an upper edge of said lid element to said sidewall and a limit bracket element adjacent said hinge lid element, said lid element movable between a first position closing said second opening and a second position abutting said limit bracket element and exposing said second opening, said limit bracket element preventing the center of mass of said lid element from being oriented vertically above said hinge when the crushing apparatus is supported on a horizontal support surface by said post elements.

14. A crushing apparatus according to claim 10 including a crank arm connected to said shaft and ratchet means associated with said shaft for permitting ratchet rotation of said shaft by said crank arm.

15. A crushing apparatus according to claim 10 wherein said drive rod has a wing projecting therefrom and received by said support bracket, said post member being attached to said wing.

* * * * *